US012129737B1

(12) United States Patent
Fehri

(10) Patent No.: US 12,129,737 B1
(45) Date of Patent: Oct. 29, 2024

(54) FLOW CONTROL VALVE FOR PERMANENT MAGNET ESP

(71) Applicant: Baker Hughes Oilfield Operations LLC, Houston, TX (US)

(72) Inventor: Ahmed Fehri, Tunis (TN)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/140,473

(22) Filed: Apr. 27, 2023

(51) Int. Cl.
*E21B 43/12* (2006.01)
*E21B 34/14* (2006.01)

(52) U.S. Cl.
CPC ..... *E21B 34/14* (2013.01); *E21B 43/128* (2013.01)

(58) Field of Classification Search
CPC ..... E21B 43/128
See application file for complete search history.

(56) References Cited

U.S. PATENT DOCUMENTS

| | | | | |
|---|---|---|---|---|
| 6,260,626 | B1 * | 7/2001 | Rivas | E21B 43/38 166/265 |
| 7,086,473 | B1 | 8/2006 | Bangash | |
| 7,431,093 | B2 | 10/2008 | Bearden et al. | |
| 8,522,887 | B1 * | 9/2013 | Madison | F24T 10/20 137/625.5 |
| 10,677,032 | B1 | 6/2020 | Norton | |

OTHER PUBLICATIONS

ISA/US; International Search Report and Written Opinion for PCT/US2024/026649; mailed May 29, 2024.

* cited by examiner

*Primary Examiner* — Giovanna Wright
(74) *Attorney, Agent, or Firm* — Baker Hughes Company

(57) ABSTRACT

It is desirable to prevent the unintended generation of electricity by permanent magnet motors in a submersible pumping system used to recover fluids from a wellbore. A pumping system designed to prevent the unintended generation of electricity includes a pump intake that provides a path for the wellbore fluids to enter the pump. The pumping system further includes a flow control valve assembly connected to the pump. The flow control valve assembly has a sliding sleeve and a valve control mechanism that moves the sliding sleeve between open and closed positions on the intake of the pump.

8 Claims, 3 Drawing Sheets

FLOW CONTROL VALVE FOR PERMANENT MAGNET ESP

FIELD OF THE INVENTION

Figure 1A:
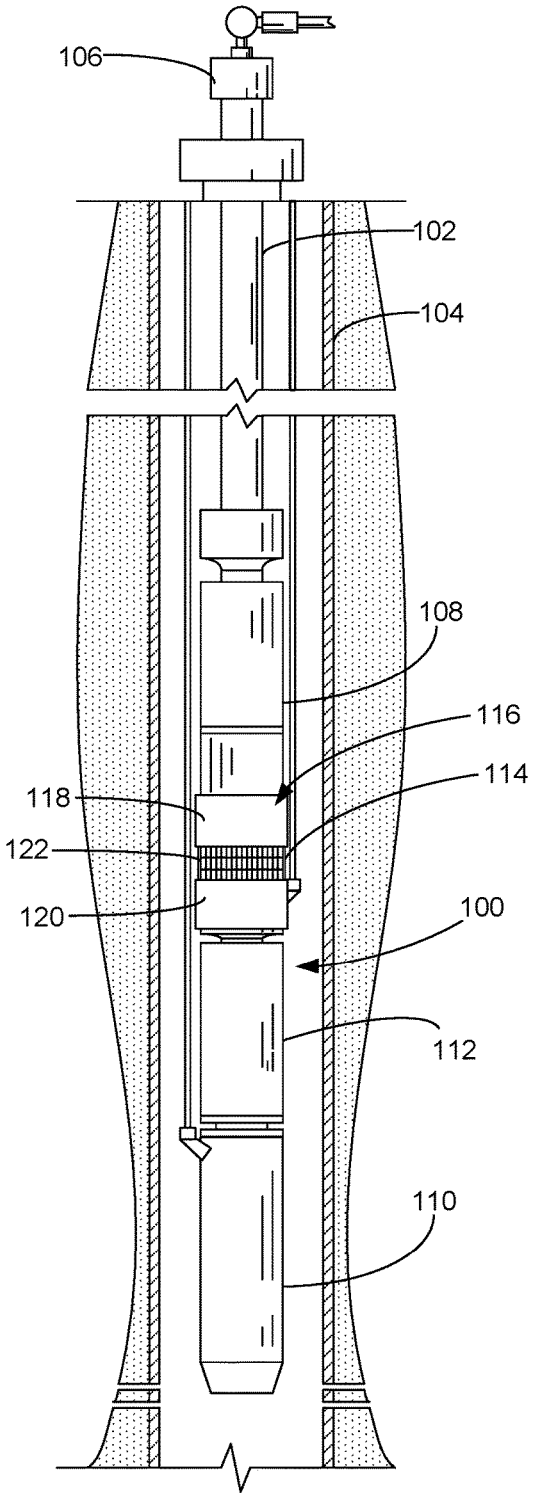

The subject matter disclosed herein relates to pumping systems, and more specifically to systems for improving the safety of pumping systems with permanent magnet motors.

BACKGROUND

Oil is typically produced by drilling wells into reservoirs in geological formations and then pumping the oil out of the reservoirs through the wells. Commonly, the oil is produced using electric submersible pumping systems ("ESPs") that are deployed in the wells. Electric power suitable for the ESPs is normally provided by electric drive systems that are positioned at the surface of each well, and is conveyed from the drive to the ESP via a power cable that extends from the drive system to the deployed ESP.

An ESP typically includes a pump, a seal section, and a motor. The power from the electric drive system is provided to the motor, which drives the pump. Frequently, the motor is a rotary motor which drives a shaft that is coupled to the shaft of a centrifugal pump. The rotating motor shaft causes the pump shaft to rotate, generating fluid pressure that forces fluid out of the well.

The motor is typically one of two types: an induction motor: or a permanent magnet motor. In the case of an induction motor, power (usually three-phase AC power) is provided to the windings of the motor's stator, causing the stator to generate rotating magnetic fields in the stator. These rotating magnetic fields induce currents and corresponding magnetic fields in a rotor, causing the rotor and the motor shaft to rotate and drive the pump. In the case of a permanent magnet motor, three-phase AC power is provided to the motor's stator windings, generating rotating magnetic fields as in the induction motor. The rotor of the permanent magnet motor, however, has a set of permanent magnets which cause the rotor to rotate in the rotating magnetic fields generated by the stator. %

In normal operation, power supplied to a conventional permanent magnet ESP motor causes the motor to rotate, which causes fluid (e.g., oil) to flow through the pump. What is less frequently considered, however, is that the reverse of this sequence may also be true, that is, the motor can function as a generator. If fluid is caused to flow through the pump, this may cause the pump to rotate, which will in turn cause the rotor to rotate and generate an AC voltage which is applied to the conductors of the power cable. The generated voltage is often unexpected because the motor normally consumes electrical energy, and it may be dangerous or even fatal to persons working on the pumping system. It is therefore desirable to provide a mechanism for preventing the unintentional generation of electricity from a permanent magnet motor.

SUMMARY OF THE INVENTION

Certain embodiments commensurate in scope with the original claims are summarized below. These embodiments are not intended to limit the scope of the claims, but rather these embodiments are intended only to provide a brief summary of possible forms of the claimed subject matter. Indeed, the claims may encompass a variety of forms that may be similar to or different from the embodiments set forth below.

In one embodiment, the present disclosure is directed to a pumping system for use in recovering fluids from a wellbore. The pumping system includes an electric motor and a pump driven by the electric motor. The pump includes a pump intake that provides a path for the wellbore fluids to enter the pump. The pumping system further includes a flow control valve assembly connected to the pump. The flow control valve assembly has a sliding sleeve and a valve control mechanism that moves the sliding sleeve between open and closed positions on the intake of the pump.

In another embodiment, the present disclosure is directed to a flow control valve assembly for use in selectively blocking the intake of a submersible pumping system. In this embodiment, the flow control valve assembly includes a sliding sleeve and a valve control mechanism that moves the sliding sleeve between open and closed positions on the intake of the pump.

In yet another embodiment, the present disclosure is directed to a pumping system for use in recovering fluids from a wellbore. The pumping system includes a permanent magnet electric motor and a pump driven by the permanent magnet electric motor. The pump includes a pump intake that provides a path for the wellbore fluids to enter the pump. The pumping system further includes a flow control valve assembly connected to the pump to selectively prevent flow through the intake of the pump. The flow control valve assembly includes an upper housing, a lower housing, a sliding sleeve, and a valve control mechanism that moves the sliding sleeve between open and closed positions to selectively block flow through the intake of the pump.

BRIEF DESCRIPTIONS OF THE DRAWINGS

These and other features, aspects, and advantages of the present disclosure will become better understood when the following detailed description is read with reference to the accompanying drawings in which like characters represent like parts throughout the drawings, wherein:

FIG. 1A presents an overview of a submersible pumping system deployed in well with a flow control valve in an open state.

Figure 1B:
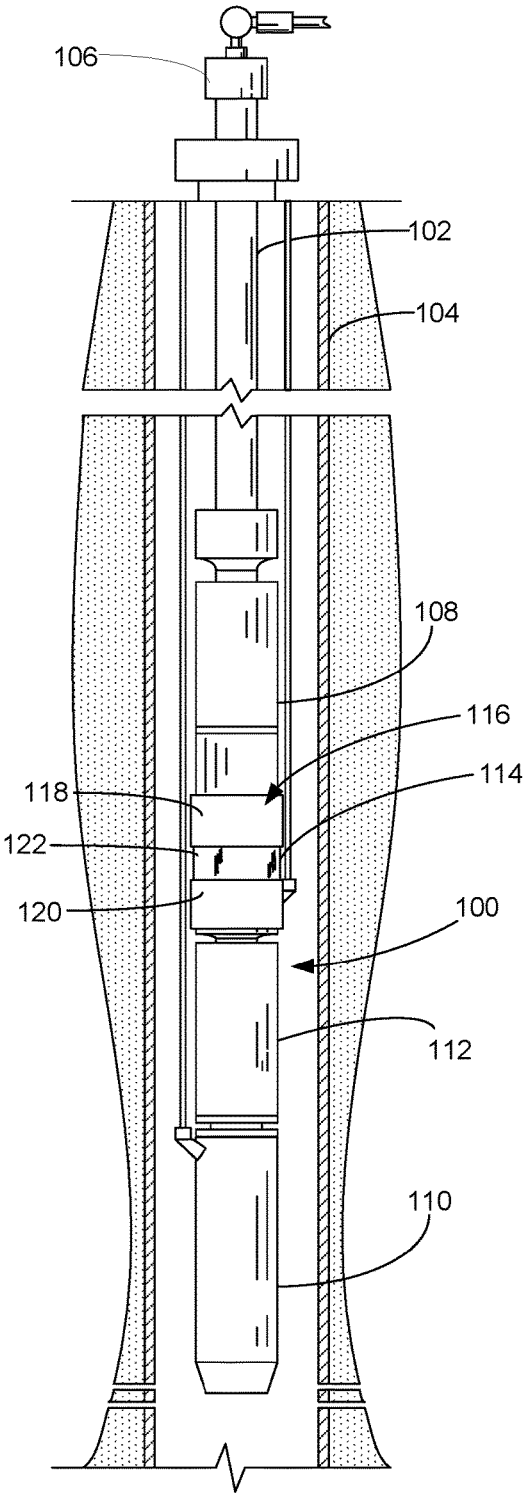

FIG. 1B presents an overview of a submersible pumping system deployed in well with the flow control valve in a closed state.

Figure 2A:
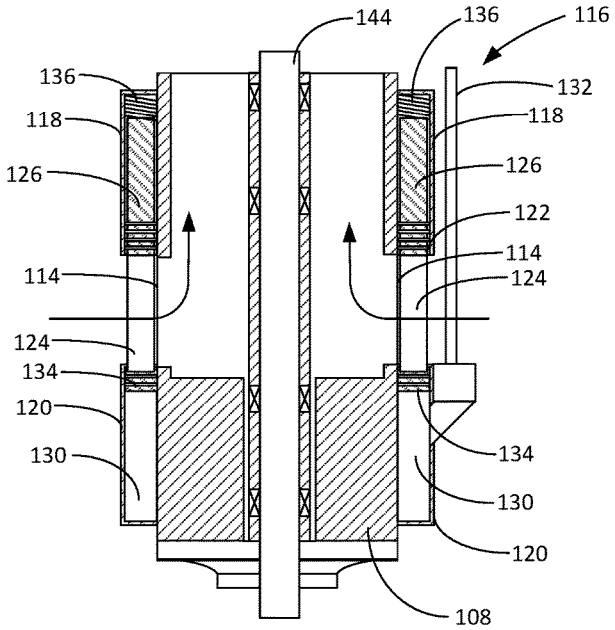

FIG. 2A presents a cross-sectional view of a first embodiment of the flow control valve assembly in an open state.

Figure 2B:
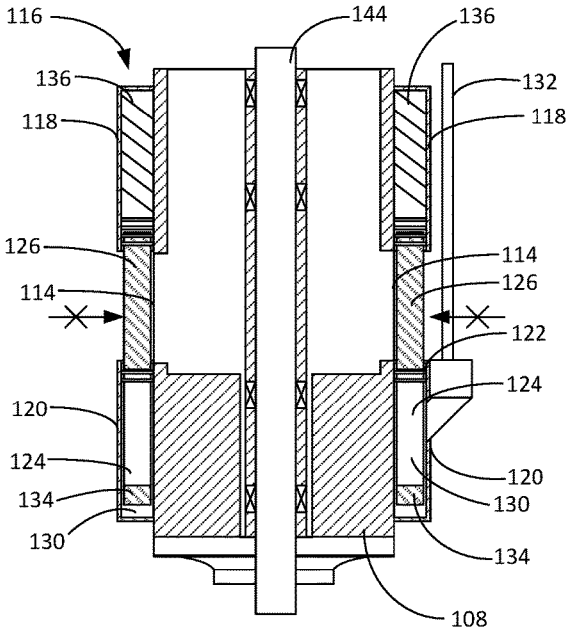

FIG. 2B presents a cross-sectional view of the first embodiment of the flow control valve assembly in a closed state.

Figure 2C:
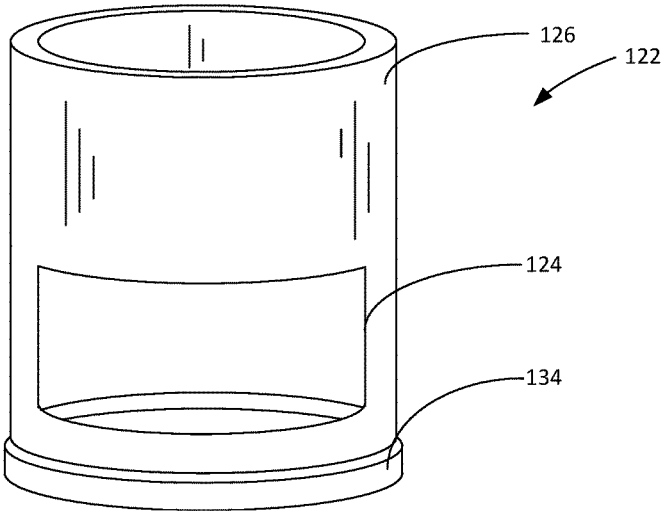

FIG. 2C is a perspective view of the sliding sleeve of the first embodiment of the flow control valve assembly.

Figure 3A:
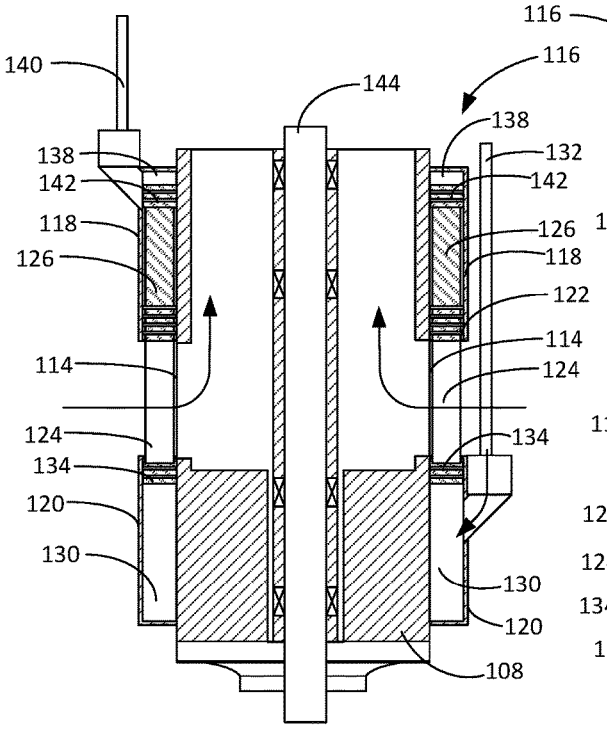

FIG. 3A presents a cross-sectional view of a second embodiment of the flow control valve assembly in an open state.

Figure 3B:
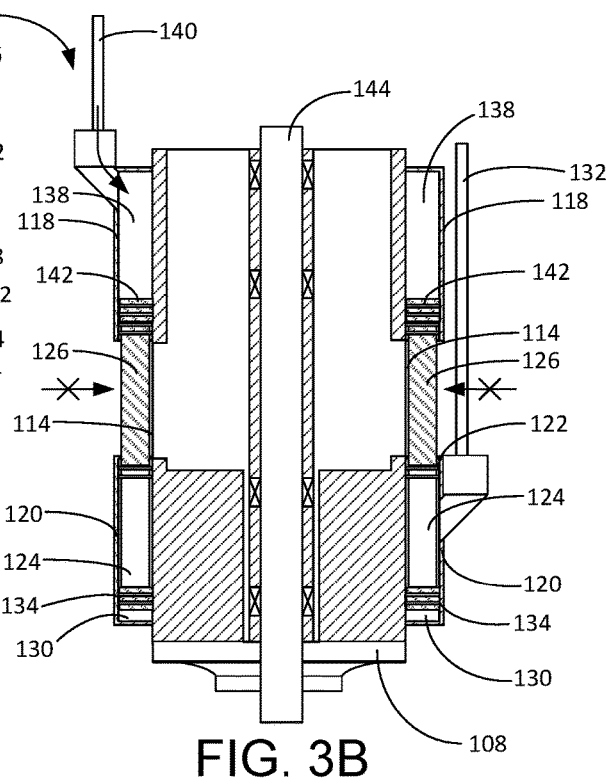

FIG. 3B presents a cross-sectional view of the second embodiment of the flow control valve assembly in a closed state.

Figure 3C:
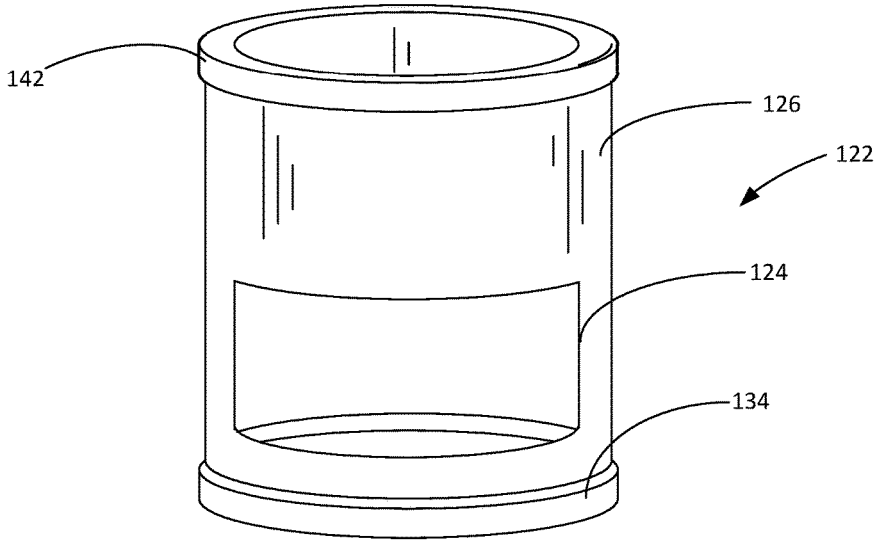

FIG. 3C is a perspective view of the sliding sleeve of the second embodiment of the flow control valve assembly.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

In accordance with an embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids, including water. It will also be understood that, although each of the components of the pumping system are primarily disclosed in a submersible application, some or all of these components can also be used in surface pumping operations. It will be appreciated that the pumping system 100 can also be deployed in a horizontal or deviated wellbore 104.

The pumping system 100 includes some combination of a pump 108, a motor 110 and a seal section 112. The motor 110 is an electrical motor that receives power from a surface-mounted motor control unit (not shown). In exemplary embodiments, the motor 110 is a permanent magnet motor. When energized, the motor 110 drives a shaft or series of interconnected shafts 144 that causes the pump 108 to operate. The seal section 112 shields the motor 110 from mechanical thrust produced by the pump 108 and provides for the expansion of motor lubricants during operation. The seal section 112 also isolates the motor 110 from the wellbore fluids. The seal section 112 includes a housing (not separately designated) configured to protect the internal components of the seal section 112 from the exterior wellbore environment. It may be desirable to use tandem-motor combinations, multiple seal sections, multiple pump assemblies or other downhole components not shown in FIG. 1.

In exemplary embodiments, the pump 108 is a multistage centrifugal pump that includes a plurality of impellers and diffusers collected together as stages inside a common housing. The pump 108 includes an intake 114 that provides a path for fluids from the wellbore 104 to enter the pump 108, where they can be forced by the pump to the surface through the production tubing 102. In some embodiments, the intake 114 includes a screen or other filter to reduce the intake of sand and other solids.

The pumping system 100 includes a flow control valve assembly 116. In the embodiment depicted in FIGS. 1A-1B, the flow control valve assembly 116 is installed on the pump 108 in a manner that allows the flow control valve assembly 116 to selectively open or close the intake 114. In FIG. 1A, the flow control valve assembly 116 is illustrated in an "open" state to permit the free flow of wellbore fluids into the pump through the intake 114. In FIG. 1B, the flow control valve assembly 116 has been shifted into a "closed" state to prevent fluids from entering or exiting the pump 108 through the intake 114.

Turning to FIGS. 2A-2B and FIGS. 3A-3B, shown therein are cross-sectional depictions of first and second embodiments, respectively, of the flow control valve assembly 116. In both embodiments, the flow control valve assembly 116 includes an upper housing 118, a lower housing 120 and a sliding sleeve 122 that extends between the upper housing 118 and lower housing 120. The sliding sleeve 122 has a fluid-permeable window 124 and a fluid-impermeable blind 126. As depicted, the window 124 is located below the blind 126. In FIGS. 2A and 3A, the sliding sleeve 122 is depicted in a retracted position in which the blind 126 is concealed inside the upper housing 118 and the window 124 is aligned with the intake 114 to permit fluids to enter the pump 108 from the wellbore 104 through the window 124 and the intake 114. In FIGS. 2B-3B, the sliding sleeve 122 has been shifted to a deployed state in which the blind 126 is aligned with the intake 114 and the window 124 is concealed in the lower housing 120. In the closed state depicted in FIGS. 2B and 3B, the blind 126 seals around the outside of the intake 114 to prevent fluids from passing into, or out of, the pump 108 through the intake 114.

The flow control valve assembly 116 includes a valve control mechanism 128 that controls the position of the sliding sleeve 122 and the state of the flow control valve assembly 116. In the embodiment depicted in FIGS. 2A-2B, the valve control mechanism 128 includes a first hydraulic chamber 130 that is connected to a first control line 132 that extends to the surface. The first control line 132 provides a selectively pressurized fluid (e.g., hydraulic oil) to the first hydraulic chamber 130. As illustrated in FIG. 2C, the sliding sleeve 122 of the first embodiment includes a first piston 134 that is sized and configured to form a hydraulic seal inside the first hydraulic chamber 130. Although the first piston 134 is depicted as an integrated part of the sliding sleeve 122, in other embodiments the first piston 134 is a separate component that is secured to the sliding sleeve 122.

The control mechanism 128 further includes a spring 136 captured between the sliding sleeve 122 and the upper housing 118 such that the spring 136 applies a compressive force to urge the sliding sleeve 122 into a deployed position. In FIG. 2A, the sliding sleeve 122 has been forced upward by the first piston 134 such that the sliding sleeve 122 compresses the spring 136 within the upper housing 118. Increasing the pressure inside the first hydraulic chamber 130 forces the first piston 134 and sliding sleeve 122 upward such that the window 124 is aligned with the intake 114 and the spring 136 is compressed within the upper housing 118. As hydraulic pressure in the first hydraulic chamber 130 is reduced, the force applied by the spring 136 overcomes the pressure applied to the first piston 134 and the sliding sleeve 122 deploys to the closed position depicted in FIG. 2B. Thus, by modulating the hydraulic pressure inside the first hydraulic chamber 130 with the first control line 132, the sliding sleeve 122 can be selectively shifted or switched between "open" and "closed" positions.

Although the first hydraulic chamber 130 is depicted in the lower housing 120, it will be appreciated that in other embodiments, the first hydraulic chamber 130 is located in the upper housing 118. In these embodiments, the first piston 134 is also located in the upper housing 118 and the spring 136 is located in the lower housing 120. In this configuration, the loss of hydraulic pressure in the first control line 132 causes the sliding sleeve 122 to "fail-open" such that the spring 136 pushes the window 124 into alignment with the intake 114. If the first hydraulic chamber 130 is located in the lower housing 120, as depicted in FIGS. 2A-2B, the flow control valve assembly 116 can be configured for a fail-open operation if the sliding sleeve 122 is configured such that the window 124 is located above the blind 126 and the loss of hydraulic pressure on the first control line 132 would allow the spring 136 to push the sliding sleeve 122 downward such that the window 124 is in alignment with the intake 114.

In the embodiment depicted in FIGS. 3A-3C, the valve control mechanism 128 includes a second hydraulic chamber 138 and a second control line 140, and the sliding sleeve 122 includes a second piston 142. In these embodiments, the second hydraulic chamber 138 and second piston 142 have replaced the spring 136. In this embodiment, the sliding sleeve 122 can be placed and maintained in the open position by increasing the pressure in the first hydraulic chamber 130. To place the sliding sleeve 122 in the closed position, the pressure in the second hydraulic chamber 138 is increased while decreasing the pressure in the first hydraulic chamber 130 to push the sliding sleeve 122 into a position in which the blind 126 blocks the intake 114 of the pump 108.

Thus, the flow control valve assembly 116 provides a reliable mechanism for selectively closing the intake 114 of the pump 108. Although embodiments of the flow control valve assembly 116 have been disclosed as having a linearly reciprocating sliding sleeve 122, in other embodiments the flow control valve assembly 116 includes a rotary valve element that includes a window and a blind that can be rotated into alignment with the intake 114 to block or permit fluid flow through the intake. The rotary valve element can be driven by a mechanical, electrical or hydraulic actuator.

Although the flow control valve assembly 116 has been disclosed in connection with sealing the intake 114 of the pump 108, the flow control valve assembly 116 can also be used to close other holes or ports within the pumping system 100. For example, if the pumping system includes a gas separator, the flow control valve assembly 116 can be used to selectively isolate the internal components of the gas separator from the fluids in the wellbore. The exemplary embodiments include the use of multiple flow control valve assemblies 116 within the pumping system 100.

In a first mode of operation, the flow control valve assembly 116 is used to prevent the flow of fluid through the pump 108 during an installation procedure. In this mode of operation, the flow control valve assembly 116 is moved into the closed position before the pump 108 is installed in the wellbore 104. This prevents fluid from passing upward through the pump 108 and inducing a rotation in the shaft 144 as the pump 108 is lowered through the liquid column in the wellbore. Once the pump 108 has been installed within the wellbore 104, the flow control valve assembly 116 can be activated to open the intake 114 of the pump 108. The motor 110 can then be energized to drive the pump 108 to push liquids from the wellbore 104 to the surface through the production tubing 102.

In a second mode of operation, the flow control valve assembly 116 is used to prevent the flow of fluid through the pump 108 as the pump 108 is removed from the wellbore 104. In this mode of operation, the motor 110 is shut down and the flow control valve assembly 116 is moved from the open position to the closed position. As the pump 108 is lifted out of the wellbore 104, residual liquid in the pump 108 and production tubing 102 is prevented from draining out of the pump 108 by the flow control valve assembly 116 blocking the intake 114. This prevents the unintended rotation of the pump 108 caused by fluid that would otherwise drain out of the intake 114 as the pump 108 is lifted out of the wellbore 104.

In yet a third mode of operation, the flow control valve assembly 116 is used to mitigate the risks associated with a blowout during the installation of the pumping system 100. In some cases, pumping systems are installed shortly after the completion of the well. Although a blowout prevent (BOP) on the surface can be used to seal around the outside of the production tubing, the open intake of the pump provides a path for fluids to nonetheless pass from the well to the surface through the pump and production tubing. This presents a risk in the event the well experiences a blowout of kick as the pumping system is being installed in the well because the high pressure fluids can reach the surface through the open intake, pump and production tubing. To mitigate against this risk, the flow control valve assembly 116 can be shifted to a closed position as the pumping system 100 is being installed in the wellbore 104 and suitable connections are made between the production tubing 102, wellhead 106 and downstream surface facilities and equipment. In this way, the flow control valve assembly 116 provides a downhole blowout prevention tool that limits the risks otherwise imposed by uncontrolled fluid flow through the pump 108.

This written description uses exemplary embodiments to disclose the claimed subject matter, including the best mode, and also to enable any person skilled in the art to practice the subject matter, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pumping system for use in recovering fluids from a wellbore, the pumping system comprising:

an electric motor;

a pump driven by the electric motor, wherein the pump includes a pump intake that provides a path for the wellbore fluids to enter the pump; and a flow control valve assembly connected to the pump, wherein the flow control valve assembly comprises:

a sliding sleeve; and a valve control mechanism that moves the sliding sleeve between open and closed positions on the intake of the pump, wherein the valve control mechanism comprises:

a hydraulic chamber;

a control line connected between a source of controllably pressurized hydraulic fluid and the hydraulic chamber;

a piston connected to the sliding sleeve, wherein the piston is captured within the hydraulic chamber; and a spring configured to exert a compressive force on the sliding sleeve to urge the sliding sleeve into an open or closed position relative to the pump intake, wherein the spring does not extend over the pump intake when the sliding sleeve is in the open position.

2. The pumping system of claim 1, wherein the electric motor is a permanent magnet motor.

3. The pumping system of claim 2, wherein the sliding sleeve comprises:

a solid blind, wherein the blind blocks the intake when the blind is aligned with the intake; and a window, wherein the window permits wellbore fluids to pass through the intake when the window is aligned with the intake.

4. The pumping system of claim 3, wherein the flow control valve assembly comprises:

an upper housing connected above the pump intake; and a lower housing connected below the pump intake.

5. The pumping system of claim 1, wherein the first hydraulic chamber is located in the lower housing and the spring is located in the upper housing.

6. The pumping system of claim 1, wherein the first hydraulic chamber is located in the upper housing and the spring is located in the lower housing.

7. A flow control valve assembly for use in selectively blocking the intake of a submersible pumping system, the flow control valve assembly comprising: a sliding sleeve, wherein the sliding sleeve comprises: a solid blind, wherein the blind blocks the intake when the blind is aligned with the intake; and a window, wherein the window permits wellbore fluids to pass through the intake when the window is aligned with the intake; and a valve control mechanism that moves the sliding sleeve between open and closed positions on the intake of the pump, wherein the valve control mechanism comprises: an upper housing connected above the pump intake; a lower housing connected below the pump intake, wherein the lower housing includes a hydraulic chamber; a piston connected to the sliding sleeve, wherein the piston is captured within the hydraulic chamber; and a spring contained in the upper housing, wherein the spring abuts the solid blind to exert a compressive force on the sliding sleeve in opposition to force applied to the sliding sleeve by the piston.

8. A pumping system for use in recovering fluids from a wellbore, the pumping system comprising:

a permanent magnet electric motor;

a pump driven by the permanent magnet electric motor, wherein the pump includes a pump intake that provides a path for the wellbore fluids to enter the pump; and a flow control valve assembly connected to the pump, wherein the flow control valve assembly comprises:

an upper housing;

a lower housing;

a sliding sleeve, wherein the sliding sleeve comprises:

a solid blind, wherein the blind blocks the pump intake when the blind is aligned with the pump intake; and a window, wherein the window permits wellbore fluids to pass through the intake when the window is aligned with the intake; and a valve control mechanism that moves the sliding sleeve between open and closed positions to selectively block flow through the intake of the pump, wherein the valve control mechanism comprises:

a hydraulic chamber;

a control line connected between a source of controllably pressurized hydraulic fluid and the hydraulic chamber;

a piston connected to the sliding sleeve, wherein the piston is captured within the hydraulic chamber; and a spring configured to exert a compressive force on the sliding sleeve to urge the sliding sleeve into an open or closed position relative to the pump intake, wherein the spring does not extend over the pump intake when the sliding sleeve is in the open position.

* * * * *